United States Patent [19]

Moore

[11] Patent Number: 4,841,589

[45] Date of Patent: Jun. 27, 1989

[54] BED COVER SUPPORT STRUCTURE

[76] Inventor: Mary L. Moore, Rte. 2, Box 293, Kinston, N.C. 28365

[21] Appl. No.: 26,169

[22] Filed: Mar. 16, 1987

[51] Int. Cl.[4] ..... A47C 21/02

[52] U.S. Cl. ..... 5/504; 5/505

[58] Field of Search ..... 5/426, 504–506, 5/512

[56] References Cited

U.S. PATENT DOCUMENTS

| | | | |
|---|---|---|---|
| 1,577,089 | 3/1926 | Whitford | 5/505 |
| 2,112,122 | 3/1938 | Sullivan | 5/505 |
| 2,602,171 | 7/1952 | Good | 5/505 |
| 4,561,549 | 12/1985 | Yokohori | 5/505 X |

FOREIGN PATENT DOCUMENTS

| | | | |
|---|---|---|---|
| 4097 | of 1908 | United Kingdom | 5/505 |
| 574201 | 12/1945 | United Kingdom | 5/505 |

*Primary Examiner*—Michael F. Trettel

*Attorney, Agent, or Firm*—Rhodes, Coates & Bennett

[57] ABSTRACT

The present invention entails a bed cover support structure for supporting bed cover over a particular area of a patient's body while the patient occupies a bed. The bed cover support structure of the present invention includes an open base frame adapted to be inserted between a mattress and box springs of a bed structure. A plurality of posts extend upwardly from the base structure and include arcuate shaped arms that extend outwardly from the respective posts in cantilever fashion. The arcuately shaped arms effectively elevate and support bed cover over a selected area of a patient's body.

7 Claims, 3 Drawing Sheets

BED COVER SUPPORT STRUCTURE

FIELD OF INVENTION

The present invention relates to medical devices and more particularly to support structures utilized in conjunction with a bed to support bed cover over a selected portion of a patient's body.

BACKGROUND OF INVENTION

For those people that are affected with diseases such as rheumatoid arthritis, skin disease, bed sores, etc., one of the most uncomfortable and painful occurances is that of having bed cover laying directly adjacent and supported by an affected area of the body. For example, it is not unusual for an individual with rheumatoid arthritis to have very sensitive and sore feet that will not stand the touching and pressure created by overlying bed cover. The pain and sometimes agony caused by this situation prevents the individual or patient from sleeping and resting comfortably, all of which compound the problems of the patient.

There have been in the past attempts at providing bed cover support structures. For example, see the disclosures in the following U.S. Pat. Nos.:

1,577,089
2,106,834
4,493,121
4,214,327
1,066,976.

A review of these bed cover support structures reveal that they are large, bulky, and are very difficult to handle. In addition, they are very rigid and are not easily adjustable and adaptable to the patient's needs.

Therefore, there has been and continues to a need for a bed cover support structure that is lightweight, easy to handle, and which is adjustable and which is functionally flexible in order that the same can be used at various points around the patient's bed to protect various areas of the body such as hands, arms and feet.

SUMMARY AND OBJECTS OF THE INVENTION

The present invention presents a bed cover support structure that is of a lightweight open frame structure that is designed to be inserted between a mattress and box springs of a bed. In particular, the bed cover support structure includes an open base frame having a plurality of posts extending upwardly therefrom with each post including a cantilever arm extending outwardly therefrom for actually engaging and supporting bed cover and maintaining the supported bed cover in an elevated position over a selected area of a patient's body.

It is therefore an object of the present invention to provide a bed cover support that is of a lightweight construction and which can be easily handled and manipulated.

Still a further object of the present invention resides in the provision of a bed cover support structure that is vertically adjustable such that the bed cover can be positioned at various elevations over the selected body portion.

Another object of the present invention resides in the provision of a versatile bed cover support structure that can be utilized to support bed cover about a variety of body portions including, for example, the feet, arms, hands, etc.

Another object of the present invention resides in the provision of a bed cover support structure that includes a plurality of vertically adjustable posts that can be stationed in a series of vertical positions.

Still a further object of the present invention resides in the provision of a bed cover support structure of the character referred to above that includes a series of elongated slightly flexible vertical support posts that include arcuate arms that extend outwardly therefrom in cantilever fashion.

It is also an object of the present invention to provide a bed cover support structure that is easily and conveniently adaptable to be mounted about any area surrounding the bed structure.

Another object of the present invention resides in the provision of a bed cover support structure of the character referred to above that is of a "breakdown" design inasmuch as the parts thereof can be readily disassembled.

Other objects and advantages of the present invention will become apparent and obvious from a study of the following description and the accompanying drawings which are merely illustrative of such invention.

DETAILED DESCRIPTION OF THE INVENTION

With further reference to the drawings, the bed cover support structure of the present invention is shown therein and indicated generally by the numeral 10.

Figure 1:
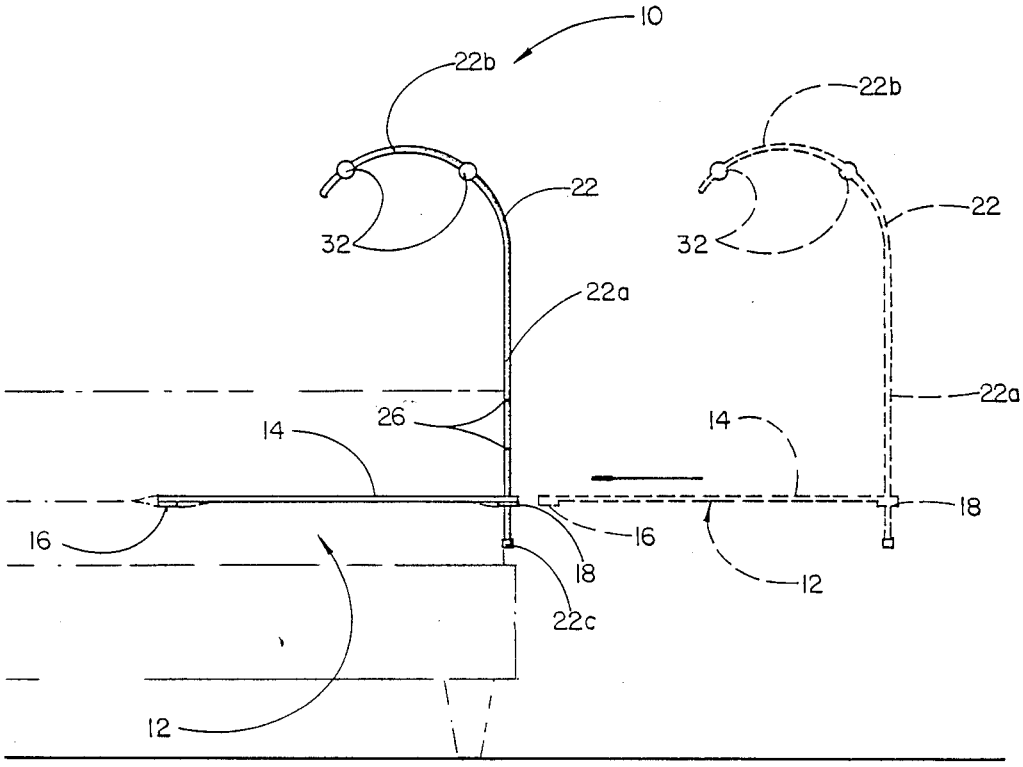
FIG. 1 is a side elevational view of the bed cover support of the present invention inserted between a mattress and box springs and with the structure shown in dotted lines being removed from such position but illustrating how the same is inserted between the mattress and box springs.
Figure 2:
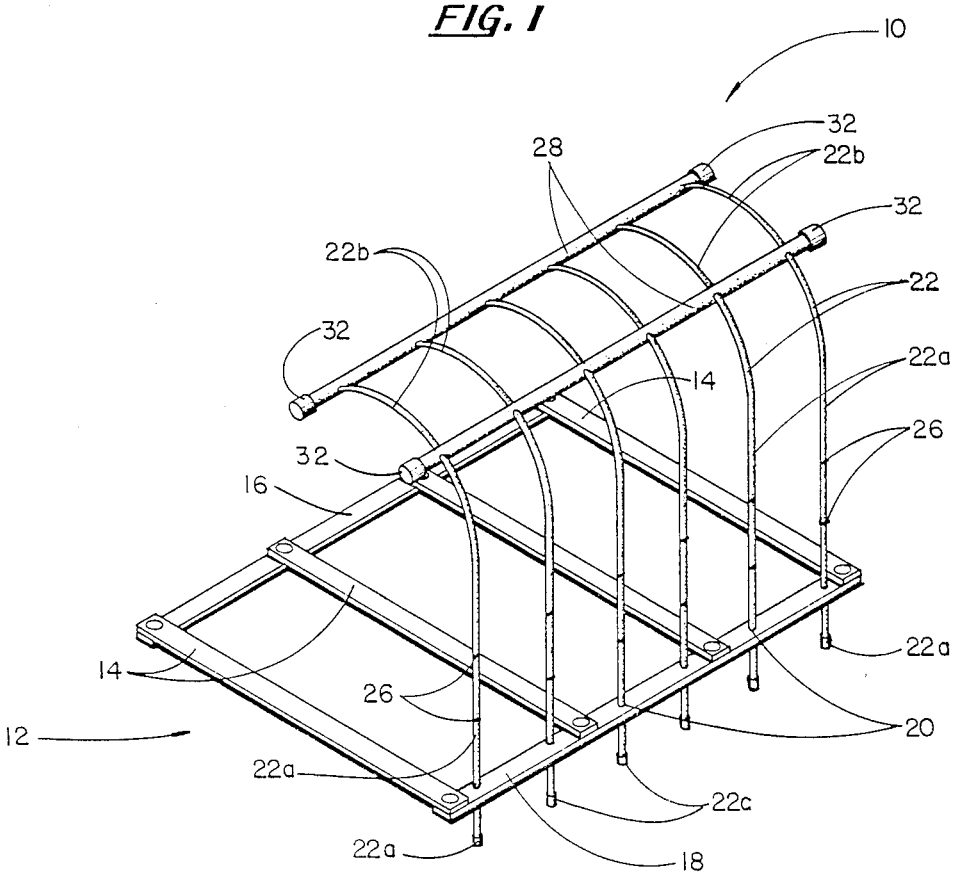
FIG. 2 is a perspective view of the bed cover support structure.
Figure 3:
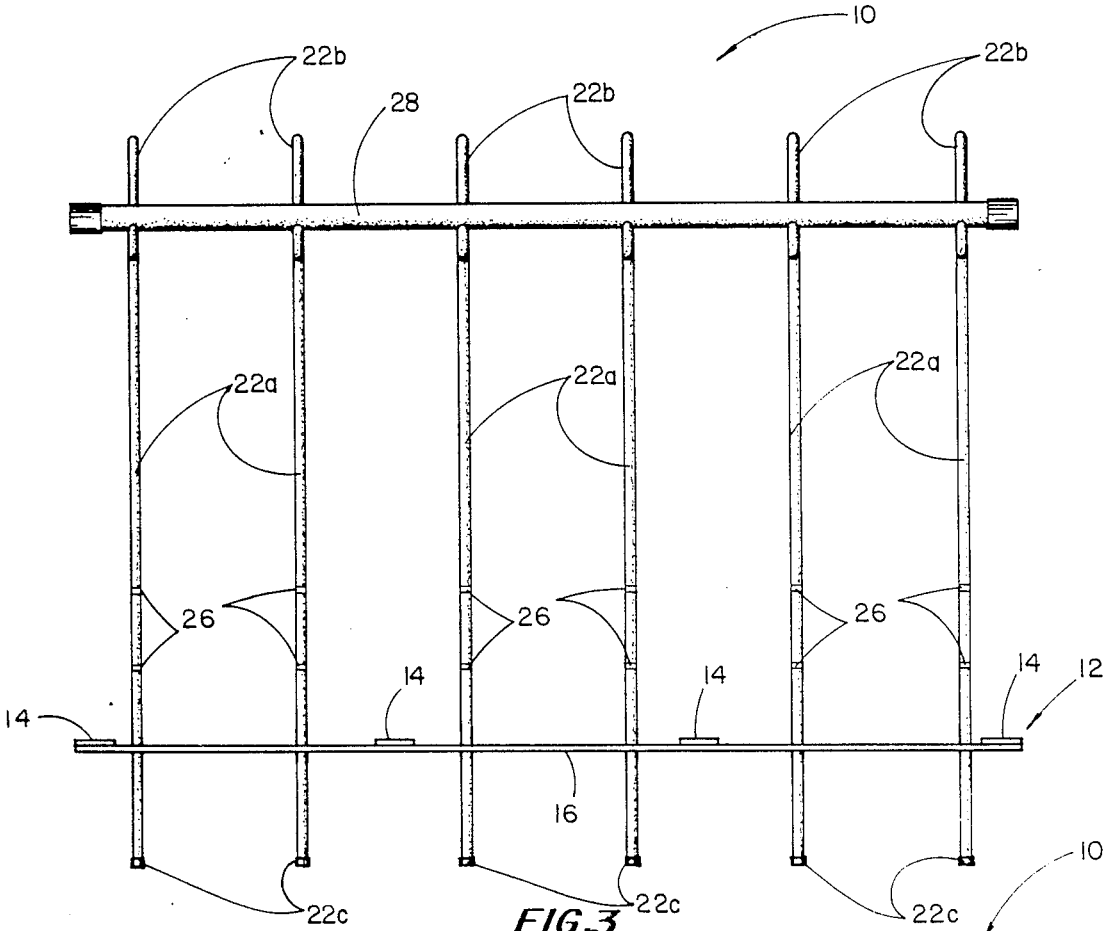
FIG. 3 is a side elevational view of the bed cover support structure.
Figure 4:
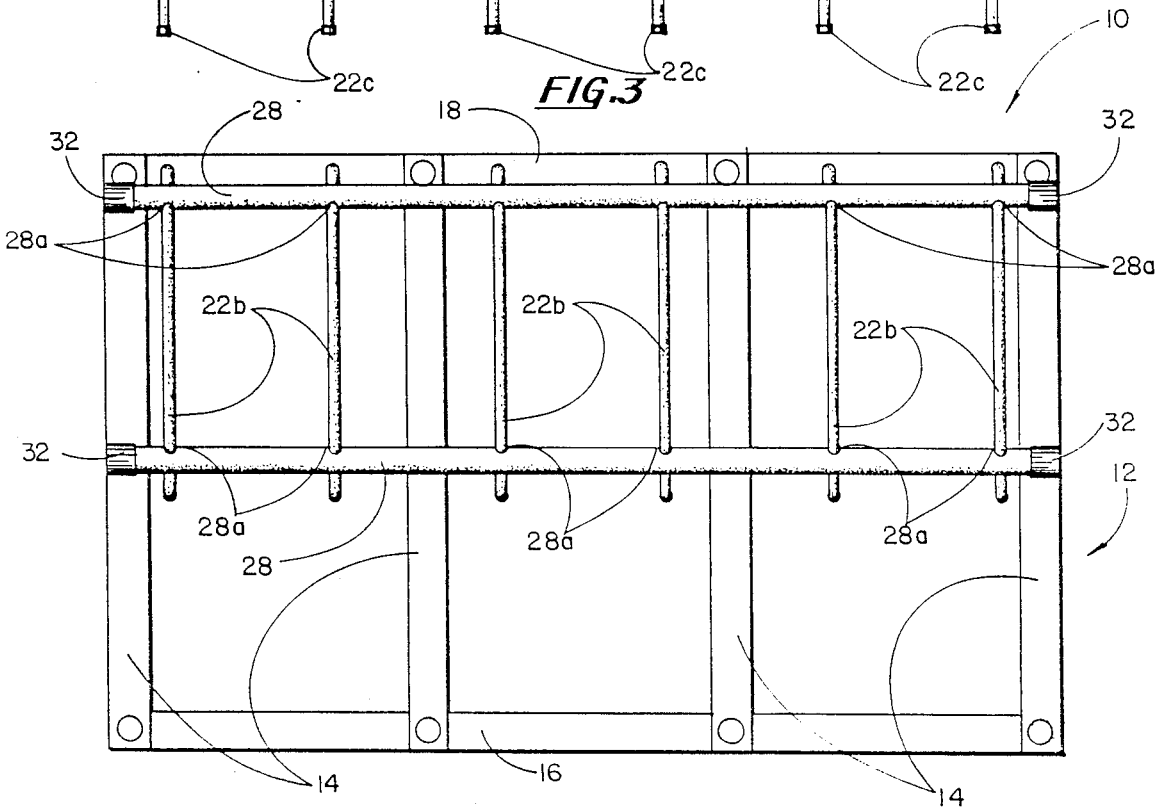
FIG. 4 is a top plan view of the bed cover support structure.
Figure 5:
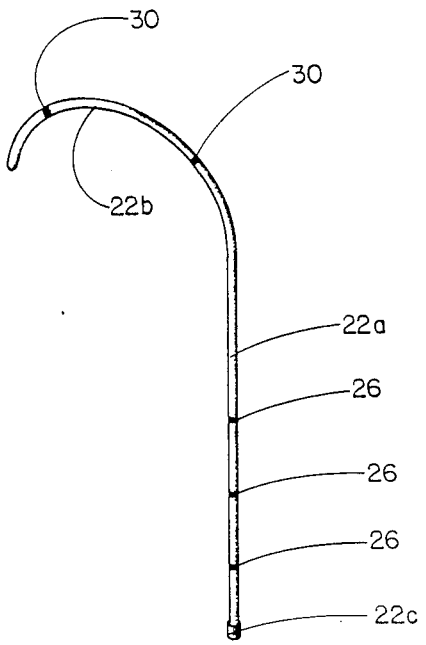
FIG. 5 is a perspective view of a respective post which forms of the present invention.
Figure 6:
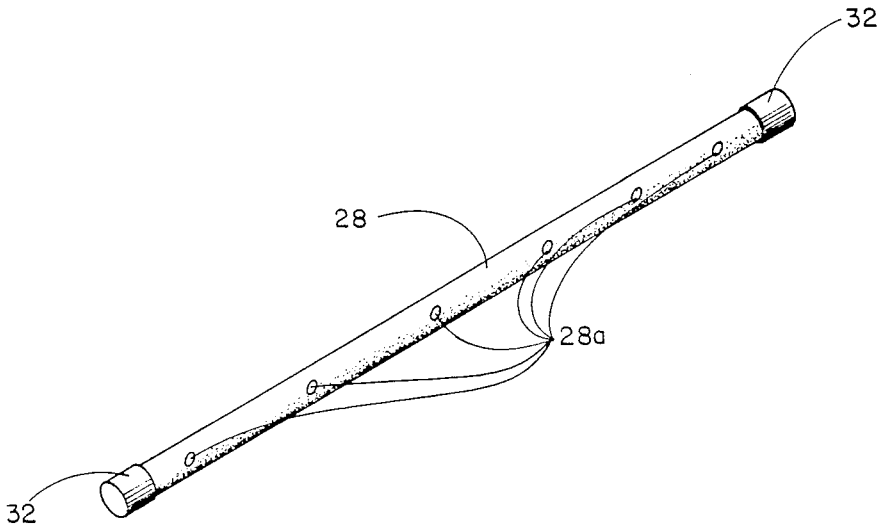
FIG. 6 is a perspective view of the connector which also forms a part of the present invention.

Viewing bed cover structure 10 in more detail it is seen that the same comprises a base frame indicated generally by the numeral 12. Base frame 12 is of a lightweight open construction and includes a plurality spaced apart transverse runners 14. Transverse runners 14 are interconnected between an elongated inner edge strip 16 and an elongated outer edge strip 18. As seen in FIG. 1 base frame 12 is designed to be inserted and supported between a mattress and box spring of a bed structure.

In the inserted position as shown in full lines in FIG. 1, outer edge strip 18 projects outwardly from between the mattress and box springs. Outer edge strip 18 includes a series of aligned openings 20 formed therein.

Moveably secured within the respective openings 20 are a series of upstanding posts 22. Posts 22 are laterally spaced and are vertically adjustable within the respective openings 20.

Each post 22 includes a lower leg portion 22*a* and an upper arm portion 22*b*.

As seen in the drawings upper arm portion 22*b* is generally arcuately shaped and extends outwardly from the leg portion 22*a* in cantilever fashion.

Provided about the bottom or lower end of each post 22 is a post stop or end cap 22*c*.

To provide the adjustable feature for the respective posts 22 each post about the lower leg portion 22*a* is provided with a series of vertically spaced notches 26 formed in the post structure itself. Notches 26 are specifically designed to form a secure and frictional fit with the respective openings 20 formed in the outer edge strip. That is, the engagement of a notch 26 with opening 20 results in the respective post 26 being firmly anchored and held by the outer edge strip 18. In addition, lower leg portion 22*a* of each post 22 can be frictionally moved up and down within respective openings 20 so as to adjust the respective posts at either of three vertical positions. Although the present disclosure discloses three vertically spaced notches, it is appreciated that the number of notches provided and accordingly the number of vertical positions can be varied.

A pair of transverse tie bars 28 are detachably mounted across the respective arms 22*b* of the post 22. Each tie bar 28 includes a series of axially spaced openings 28*a* that are particularly designed to receive arms 22*b*.

To secure tie bars 28 about the respective arms 22*b*, the arm portions are provided with a pair of arm notches 30 for receiving the respective openings 28*a* in the tie bars 28. Thus, it is appreciated that the engagement of a respective arm notch 30 with a respective opening 28*a* of a tie bar 28 results in a firm frictional fit being achieved. However, it is also realized and appreciated that the tie bars 28 can be moved along the respective arms and can in fact be easily and conveniently detached by sliding the same from engagement with the arms 22*b*.

As shown in the drawings, the respective tie bars 28 include end caps 32.

The bed cover 10 of the present invention can be constructed of various types of material. However, it is contemplated that to make the present bed cover support structure easy to handle and of a lightweight construction that plastic would be one preferable material from which the device would be constructed.

In use, base frame structure 12 is inserted between a mattress and box springs of a bed as shown in FIG. 1. Base frame 12 is inserted such that the inner edge 16 assumes an inner disposed position between the mattress and box springs while the outer edge strip 18 projects outwardly therefrom. This allows the respective posts 22 to extend upwardly adjacent the outer edge of the mattress and on upwardly above the top of the mattress after which the same curves in an arcuate fashion back over the top surface of the mattress. This enables the bed cover to be extended over the post 22 and particularly the arms 22*b*. Underneath the arcuate shaped arms 22*b* is defined an open and clear space that can be occupied by a selected part of a patient's body. For example, by stationing the bed cover support structure 10 of the present invention about the foot of a bed enables the device of the present invention to be used as a foot guard. In the same way, bed cover support structure 10 can be placed along the side of the bed and can be used to protect an arm or hand, etc.

From the above discussion it is seen that the bed cover support structure 10 of the present invention is of a lightweight design and construction and can be easily handled and moved about various positions around a bed to accommodate the particular needs of a patient. In fact, the bed cover support structure 10 of the present invention is of a "breakdown" design as the various parts thereof can be readily detached and reassembled.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended Claims are intended to be embraced therein.

What is claimed is:

1. An open frame foot or body part guard for supporting a bed cover thereover, comprising:

an open base frame designed to be inserted between the box springs and mattress of a bed;

said open base frame including an outer transverse edge strip that extends outwardly from between the box spring and the mattress;

a plurality of laterally spaced openings formed in the edge strip;

a plurality of equally and laterally spaced adjustable posts secured within the openings of the edge strip and extending upwardly therefrom to form an open frame structure;

each post including a vertical leg having upper and lower portions and a curved arm portion extending generally horizontally from the top portion of the leg, each curved portion having an outer remote end;

means for adjustably mounting the respective vertical posts for up and down movement within the openings of the edge strip;

a pair of detachably mounted transverse connector ties extending across the curve portions of the plurality of posts and interconnected between respective posts;

said pair of connector ties including a first connector tie connected to the remote ends of the curved arm portions of the posts, and a second connector tie disposed in parallel relationship to the first connector tie and connected to the curved arm portions of the post in the vicinity of where the curved arm portions extend from the upper leg portions of the post such that the pair of connector ties give stability to the entire guard and particularly to the post thereof and further wherein the connector ties prevent cover from falling downwardly between the curved arm portions; and at least one of said connector ties being detachably connected between the respective horizontal arms of the respective posts.

2. The guard for supporting bed cover of claim 1 wherein respective posts include a series of vertically spaced frictional notches, and wherein the respective openings of the edge strip includes means for engaging the respective frictional notches for stationing and supporting the respective posts in a stable and upright position.

3. The guard for supporting bed cover of claim 1 wherein each connector ties includes a series of spaced apart openings therein with the respective openings being adapted to receive the respective arms of the posts in order that each connector tie can be easily inserted onto the respective arms or removed from the respective arms.

4. The guard for supporting bed cover of claim 3 wherein each respective arm includes at least one frictional notch for securely receiving a respective opening in a connector tie such that a secure connection can be achieved between the respective arms and a respective connector tie.

5. The guard for supporting bed cover of claim 1 wherein said arms of the respective posts are generally arcuate shaped and extend from the upper portion of the respective posts in cantilever fashion.

6. The guard for supporting bed cover of claim 1 wherein the base frame is of an open construction and includes a series of spaced apart base strips interconnected between the edge strip and an inner end strip.

7. A foot or body part guard for supporting a bed cover thereover, comprising:

a base frame designed to be inserted between the box springs and mattress of a bed;

said base frame including an outer transverse edge strip that extends outwardly from between the box spring and the mattress;

a plurality of laterally spaced openings formed in the edge strips;

a plurality of laterally spaced adjustable posts secured within the openings of the edge strip;

each post including a vertical leg having upper and lower portions and an arm extending generally horizontally from the top portion of the leg;

means for adjustably mounting the respective vertical posts for up and down movement within the openings of the edge strip;

a pair of detachably mounted transverse connector ties extending across the plurality of posts and interconnected between respective posts;

at least one of said connector ties being connected between the respective horizontal arms of the respective posts;

each connector tie including a series of spaced apart opening a therein with the respective openings being adapted to receive the respective arms of the posts in order that each connector tie can be easily inserted onto the respective arms or removed from the respective arms; and each respective arm including at least one frictional notch for securely receiving a respective opening in a connector tie such that a secure connection can be achieved between the respective arms and a respective connector tie.

* * * * *